US011727864B2

(12) United States Patent
Kang et al.

(10) Patent No.: US 11,727,864 B2
(45) Date of Patent: Aug. 15, 2023

(54) PIXEL CIRCUIT BOOSTED BY A BOOST CAPACITOR

(71) Applicant: Samsung Display Co., Ltd., Yongin-Si (KR)

(72) Inventors: Jangmi Kang, Seoul (KR); Junhyun Park, Suwon-si (KR); Minjae Jeong, Hwaseong-si (KR); Hyeongseok Kim, Hwaseong-si (KR)

(73) Assignee: Samsung Display Co., Ltd., Yongin-Si (KR)

( * ) Notice: Subject to any disclaimer, the term of this patent is extended or adjusted under 35 U.S.C. 154(b) by 0 days.

(21) Appl. No.: 17/748,521

(22) Filed: May 19, 2022

(65) Prior Publication Data

US 2023/0069447 A1 Mar. 2, 2023

(30) Foreign Application Priority Data

Aug. 24, 2021 (KR) ..... 10-2021-0111975

(51) Int. Cl.
*G09G 3/32* (2016.01)

(52) U.S. Cl.
CPC ..... *G09G 3/32* (2013.01); *G09G 2300/0842* (2013.01); *G09G 2310/027* (2013.01)

(58) Field of Classification Search
CPC ..... G09G 3/32
USPC ..... 345/55
See application file for complete search history.

(56) References Cited

U.S. PATENT DOCUMENTS

2009/0009496 A1* 1/2009 Kwak ..... G09G 3/325 313/504
2012/0001896 A1* 1/2012 Han ..... G09G 3/3233 345/76
2021/0201827 A1* 7/2021 Jang ..... G09G 3/3291

FOREIGN PATENT DOCUMENTS

KR 10-0698709 B1 3/2007
KR 10-2031683 B1 11/2019
KR 10-2021-0011554 A 2/2021
KR 10-2022-0014366 A 2/2022

* cited by examiner

*Primary Examiner* — Long D Pham
(74) *Attorney, Agent, or Firm* — Innovation Counsel LLP

(57) ABSTRACT

A pixel circuit includes a light emitting element, a write transistor configured to apply a data voltage to an input node in response to a write gate signal, a storage capacitor configured to store the data voltage, a driving transistor configured to apply a driving current to the light emitting element based on the data voltage, a first compensation transistor configured to compensate for a threshold voltage of the driving transistor in response to a compensation gate signal, a first initialization transistor configured to apply a first initialization voltage to a control electrode of the driving transistor in response to an initialization gate signal, and a boost capacitor including a first electrode to which a previous initialization gate signal applied to a previous pixel row is applied and a second electrode connected to the control electrode of the driving transistor.

20 Claims, 16 Drawing Sheets

PIXEL CIRCUIT BOOSTED BY A BOOST CAPACITOR

PRIORITY STATEMENT

This application claims priority under 35 U.S.C. § 119 to Korean Patent Application No. 10-2021-0111975, filed on Aug. 24, 2021 in the Korean Intellectual Property Office KIPO, the contents of which are herein incorporated by reference in their entireties.

BACKGROUND

1. Field

Embodiments of the present inventive concept relate to a pixel circuit. More particularly, embodiments of the present inventive concept relate to a pixel circuit included in a display apparatus in which a frame frequency of a display panel is variable.

2. Description of the Related Art

In general, a display apparatus receives image data from a host processor (for example, a graphic processing unit (GPU) or a graphic card), and displays an image based on the received image data. However, a frame frequency of a rendering by a host processor may not match a frame frequency of an image displayed by the display apparatus, and a tearing phenomenon, in which a boundary line is generated in the image displayed by the display apparatus, may occur due to the mismatch of the frame frequency. In order to prevent such the tearing phenomenon, a technique for varying the frame frequency of image data provided from the host processor to the display apparatus has been developed (for example, Free-Sync mode, G-Sync mode).

A display apparatus associated with the above technique may include a pixel including a polysilicon thin film transistor and an oxide thin film transistor. The oxide thin film transistor may be connected to a control electrode of a driving transistor and unintentionally lower a voltage of the control electrode of the driving transistor corresponding to a kickback voltage. Accordingly, there is a problem in that a higher data voltage is used to display a black grayscale image.

SUMMARY

A pixel circuit including a boost capacitor to which a previous initialization gate signal is applied to boost a control electrode of a driving transistor in a self-scan period is presented.

A pixel circuit including a boost capacitor to which a next initialization gate signal is applied to boost a control electrode of a driving transistor in a scan period and a self-scan period is presented.

According to the present inventive concept, a pixel circuit includes a light emitting element, a write transistor configured to apply a data voltage to an input node in response to a write gate signal, a storage capacitor configured to store the data voltage, a driving transistor configured to apply a driving current to the light emitting element based on the data voltage, a first compensation transistor configured to compensate for a threshold voltage of the driving transistor in response to a compensation gate signal, a first initialization transistor configured to apply a first initialization voltage to a control electrode of the driving transistor in response to an initialization gate signal, and a boost capacitor including a first electrode to which a previous initialization gate signal applied to a previous pixel row is applied and a second electrode connected to the control electrode of the driving transistor.

The pixel circuit may further include a second compensation transistor configured to apply the first initialization voltage transmitted through the first initialization transistor to the control electrode of the driving transistor in response to the compensation gate signal.

The second compensation transistor may be an n-type transistor, and the first initialization transistor may be a p-type transistor.

The write transistor may be configured to apply the data voltage to the input node in a scan period and apply a black voltage to the input node in a self-scan period. The compensation gate signal may have a high level in a compensation period of the scan period and a low level in the self-scan period.

The black voltage may have a value equal to a voltage value of the data voltage displaying an image of a black grayscale.

The previous initialization gate signal may rise to a high level in the compensation period.

The write transistor may be turned on in a state in which the first compensation transistor and the second compensation transistor are turned on in the scan period to apply the data voltage to the input node.

The previous initialization gate signal may rise to a high level in the self-scan period.

The pixel circuit may further include a second initialization transistor configured to apply a second initialization voltage to an anode electrode of the light emitting element in response to the initialization gate signal, a hold capacitor including a first electrode connected to the first electrode of the storage capacitor and a second electrode connected to a driving voltage, a first emission transistor configured to transmit the driving voltage to the input node in response to a first emission signal, and a second emission transistor configured to transmit the driving current to the light emitting element in response to a second emission signal.

The second initialization voltage may be smaller than the first initialization voltage.

According to the present inventive concept, a pixel circuit includes a light emitting element, a write transistor configured to apply a data voltage to an input node in response to a write gate signal, a storage capacitor configured to store the data voltage, a driving transistor configured to apply a driving current to the light emitting element based on the data voltage, a first compensation transistor configured to compensate for a threshold voltage of the driving transistor in response to a compensation gate signal, a first initialization transistor configured to apply a first initialization voltage to a control electrode of the driving transistor in response to an initialization gate signal, and a boost capacitor including a first electrode to which a next initialization gate signal applied to a next pixel row is applied and a second electrode connected to the control electrode of the driving transistor.

The pixel circuit may further include a second compensation transistor configured to apply the first initialization voltage transmitted through the first initialization transistor to the control electrode of the driving transistor in response to the compensation gate signal.

The second compensation transistor may be an n-type transistor, and the first initialization transistor may be a p-type transistor.

The write transistor may be configured to apply the data voltage to the input node in a scan period and apply a black voltage to the input node in a self-scan period. The compensation gate signal may have a high level in a compensation period of the scan period and a low level in the self-scan period.

The black voltage may have a value equal to a voltage value of the data voltage displaying an image of a black grayscale.

The next initialization gate signal may rise to a high level in the compensation period.

The write transistor may be turned on in a state in which the first compensation transistor and the second compensation transistor are turned on in the scan period to apply the data voltage to the input node.

The next initialization gate signal may rise to a high level in the self-scan period.

The pixel circuit may further include a second initialization transistor configured to apply a second initialization voltage to an anode electrode of the light emitting element in response to the initialization gate signal, a hold capacitor including a first electrode connected to the first electrode of the storage capacitor and a second electrode connected to a driving voltage, a first emission transistor configured to transmit the driving voltage to the input node in response to a first emission signal, and a second emission transistor configured to transmit the driving current to the light emitting element in response to a second emission signal.

The second initialization voltage may be smaller than the first initialization voltage.

Therefore, the pixel circuit according to the disclosure may compensate for a voltage decrease of a control electrode of a driving transistor caused by a compensation transistor.

The pixel circuit according to the disclosure may sufficiently secure threshold voltage compensation time by distinguishing between a period during which a write transistor applies a data voltage and a period during which a threshold voltage is compensated.

The pixel circuit may lower a voltage value of a data voltage applied to display a black grayscale image by boosting the control electrode of the driving transistor.

The pixel circuit may enhance the hysteresis characteristic of the driving transistor by biasing the driving transistor through the boost capacitor.

The pixel circuit may increase a voltage of the first electrode of the boost capacitor while a first initialization voltage is being applied to the control electrode of the driving transistor, so that the difference in luminance between pixels due to the distribution of the boost capacitor may be reduced.

However, the effects of the present inventive concept are not limited to the above-described effects, and may be expanded without departing from the spirit and scope of the present inventive concept.

DETAILED DESCRIPTION OF THE EMBODIMENTS

Hereinafter, the present inventive concept will be described in detail with reference to the accompanying drawings.

Figure 1:
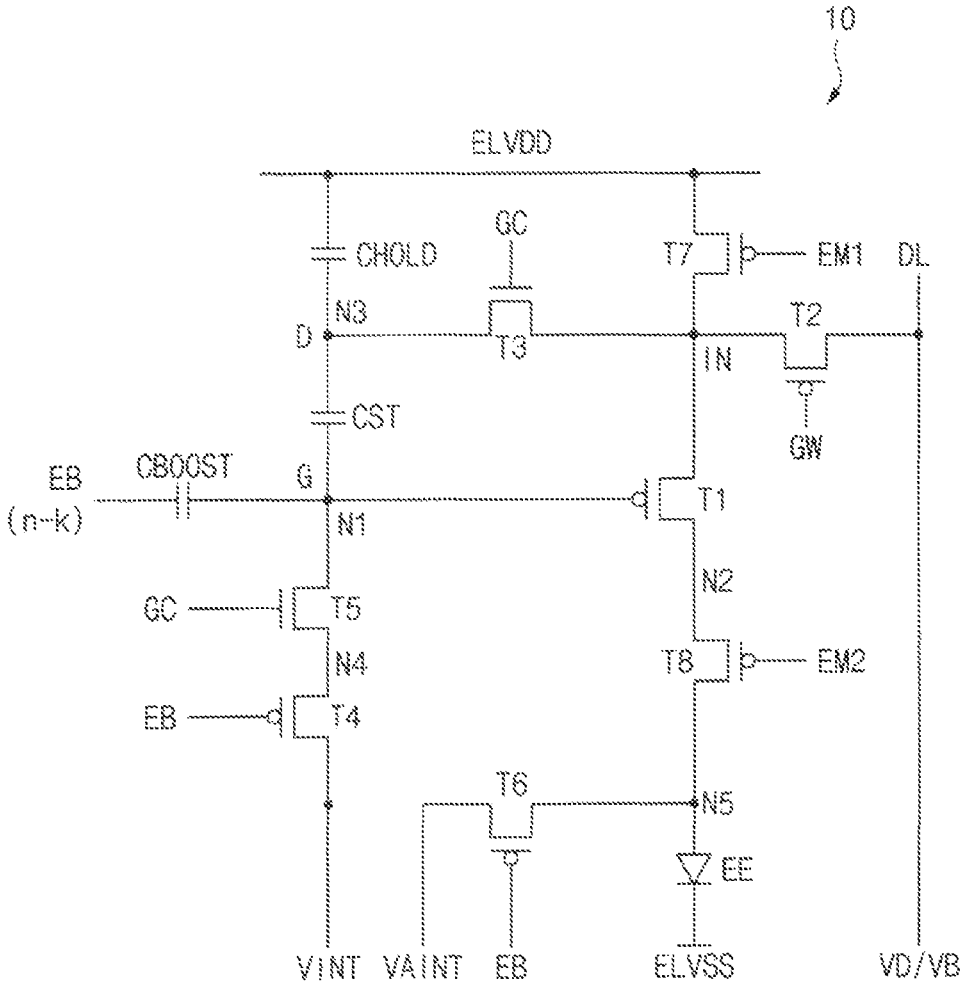
FIG. 1 is a circuit diagram illustrating a pixel circuit according to embodiments of the present inventive concept.
Figure 2:
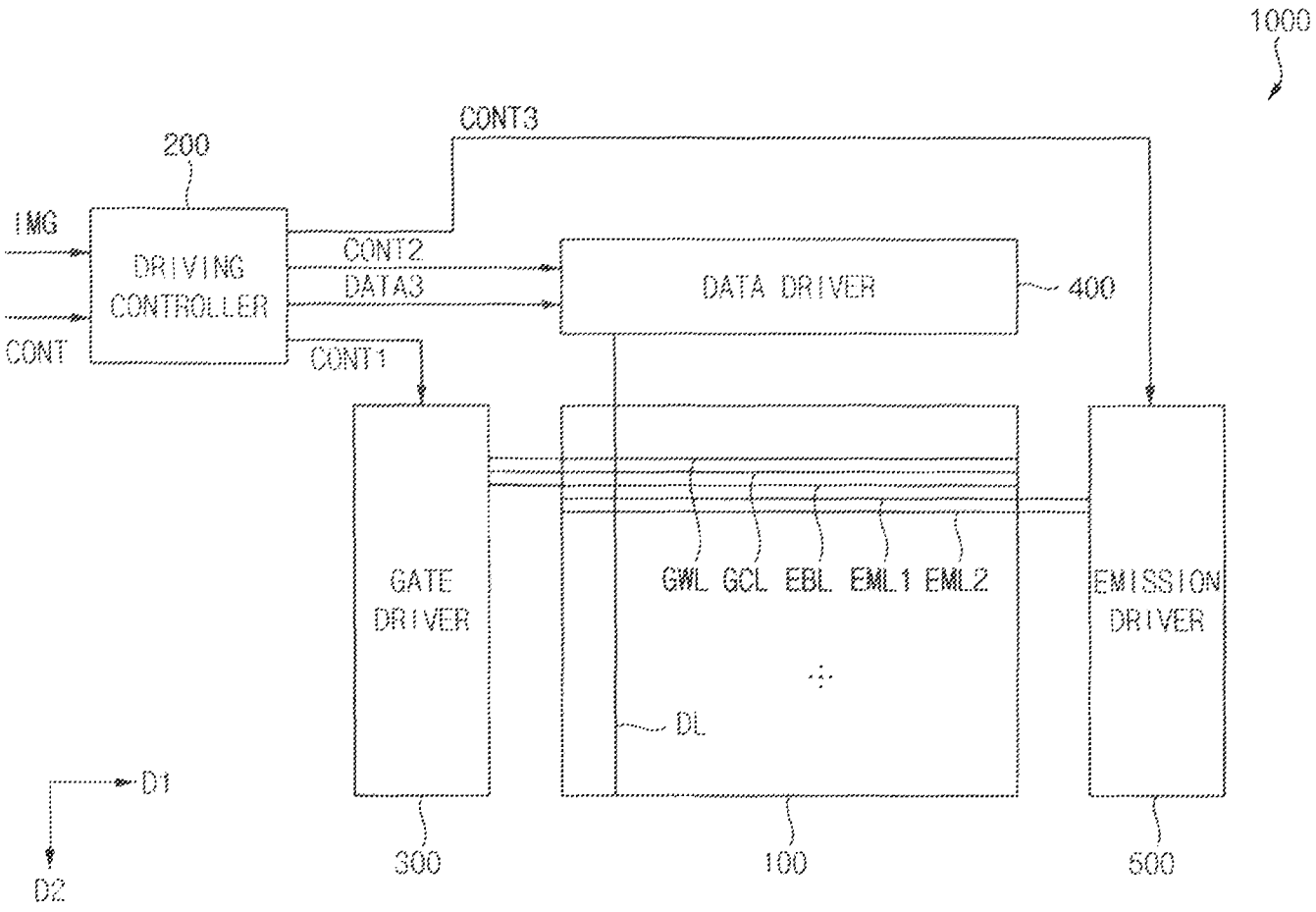
FIG. 2 is a block diagram illustrating an example of a display apparatus including the pixel circuit 10 of FIG. 1.

FIG. 1 is a circuit diagram illustrating a pixel circuit 10 according to embodiments of the present inventive concept, and FIG. 2 is a block diagram illustrating an example of a display apparatus 1000 including the pixel circuit 10 of FIG. 1.

Referring to FIG. 1, the pixel circuit 10 may include a light emitting element EE, a driving transistor T1, a write transistor T2, a first compensation transistor T3, a storage capacitor CST, and a first initialization transistor T4, and a boost capacitor CBOOST. In some embodiments, the pixel circuit 10 may further include a second compensation transistor T5. In some embodiments, the pixel circuit 10 may further include a second initialization transistor T6, a hold capacitor CHOLD, a first emission transistor T7, and a second emission transistor T8.

In an embodiment, the pixel circuit 10 may include a driving transistor T1 including a control electrode connected to a first node N1, an input electrode connected to an input node IN, and an output electrode connected to a second node N2; a write transistor T2 including a control electrode to which a write gate signal GW is applied, an input electrode to which a data voltage VD (or a black voltage VB) is applied, and an output electrode connected to the input node IN; a first compensation transistor T3 including a control electrode to which a compensation gate signal GC is applied, an input electrode to which the input node IN is connected, and an output electrode to which a third node N3 is connected; a first initialization transistor T4 including a control electrode to which an initialization gate signal EB is applied, an input electrode to which a first initialization voltage VINT is applied, and an output electrode to which a fourth node N4 is connected; a second compensation transistor T5 including a control electrode to which the compensation gate signal GC is applied, an input electrode to which the fourth node N4 is connected, and an output electrode to which the first node N1 is connected; a second initialization transistor T6 including a control electrode to which the initialization gate signal EB is applied, an input electrode to which a second initialization voltage VAINT is applied, and an output electrode to which a fifth node N5 is connected, a first emission transistor T7 including a control electrode to which a first emission signal EM1 is applied, an input electrode to which a driving voltage ELVDD is applied, and an output electrode to which the input node IN is connected; a second emission transistor T8 including a control electrode to which a second emission signal EM2 is applied, an input electrode to which the second node N2 is connected, and an output electrode to which the fifth node N5 is connected; a storage capacitor CST including a first electrode connected to the third node and a second electrode connected to the first node N1; a hold capacitor CHOLD including a first electrode connected to the third node N3 and a second electrode to which the driving voltage ELVDD is applied; a boost capacitor CBOOST including a first electrode to which a previous initialization gate signal EB(n−k) (where k is a positive integer) applied to a previous pixel row is applied and a second electrode connected to the control electrode of the driving transistor T1; and a light emitting element EE including an anode electrode to which the fifth node N5 is connected and a cathode electrode to which a common voltage ELVSS is connected. In this case, k indicates the position number of the previous pixel row. The pixel row may represent a set of pixels connected to same gate lines GWL, GCL, or EBL.

Referring to FIG. 2, the display apparatus 1000 may include a display panel 100, a driving controller 200, a gate driver 300, a data driver 400, and an emission driver 500. In some embodiments, at least two or more of the driving controller 200, the gate driver 300, the data driver 400, and the emission driver 500 may be integrated into one chip.

The display panel 100 may include a plurality of gate lines GWL, GCL, and EBL, a plurality of data lines DL, a plurality of emission lines EML1 and EML2, and a plurality of pixel circuits 10 electrically connected to the plurality of gate lines GWL, GCL, and EBL, the plurality of data lines DL, and the plurality of emission lines EML1 and EML2. The gate lines GWL, GCL, and EBL and the emission lines EML1 and EML2 may extend in a first direction D1, and the data lines DL may extend in a second direction D2 crossing the first direction D1. The pixel circuit 10 may be disposed in the display panel 100.

The driving controller 200 may receive input image data IMG and an input control signal CONT from an external apparatus (for example, a graphic processing unit (GPU), etc.). For example, the input image data IMG may include red image data, green image data, and blue image data. In some embodiments, the input image data IMG may further include white image data. In another example, the input image data IMG may include magenta image data, yellow image data, and cyan image data. The input control signal CONT may include a master clock signal and a data enable signal. The input control signal CONT may further include a vertical synchronization signal and a horizontal synchronization signal.

The driving controller 200 may generate a first control signal CONT1, a second control signal CONT2, a third control signal CONT3, and data signal DATA based on the input image data IMG and the input control signal CONT.

The driving controller 200 may generate the first control signal CONT1 for controlling operation of the gate driver 300 based on the input control signal CONT and output the first control signal CONT1 to the gate driver 300. The first control signal CONT1 may include a vertical start signal and a gate clock signal.

The driving controller 200 may generate the second control signal CONT2 for controlling operation of the data driver 500 based on the input control signal CONT and output the generated second control signal CONT2 to the data driver 400. The second control signal CONT2 may include a horizontal start signal and a load signal.

The driving controller 200 may receive the input image data IMG to generate the data signal DATA. The driving controller 200 may output the data signal DATA to the data driver 400.

The gate driver 300 may generate the gate signals GW, GC, and EB for driving the gate lines GWL, GCL, and EBL in response to the first control signal CONT1 received from the driving controller 200. The gate driver 300 may output the gate signals GW, GC, and EB to the gate lines GWL, GCL, and EBL. For example, the gate driver 300 may sequentially output the gate signals GW, GC, and EB to the gate lines GWL, GCL, and EBL.

The data driver 400 may receive the second control signal CONT2 and the data signal DATA from the driving controller 200. The data driver 400 may convert the data signal DATA into a data voltage having an analog type. The data driver 400 may output the data voltage to the data line DL.

The emission driver 500 may generate the emission signals EM1 and EM2 for driving the emission lines EML1 and EML2 in response to the third control signal CONT3 input from the driving controller 200. The emission driver 600 may output the emission signals EM1 and EM2 to the emission lines EML1 and EML2.

Figure 3:
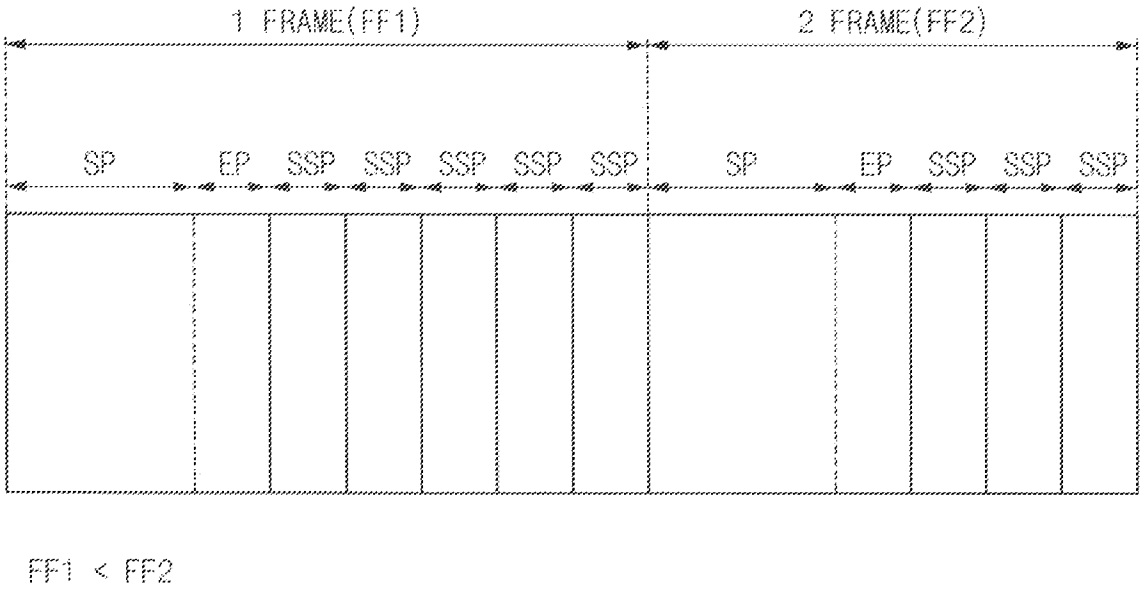
FIG. 3 is a diagram illustrating an example in which the pixel circuit of FIG. 1 is driven according to time.

FIG. 3 is a diagram illustrating an example driving method for the pixel circuit 10 of FIG. 1.

Referring to FIGS. 2 and 3, the display apparatus 1000 may display an image with various frame frequencies according to driving conditions. For example, the display apparatus 1000 may display an image with various frame frequencies ranging from 1 Hz to 120 Hz. One frame may have one scan period SP and one emission period EP when the frame frequency is the maximum frequency. One frame may have one scan period SP, one emission period EP, and at least one self-scan period SSP when the frame frequency is not the maximum frequency. Specific details of the scan period SP, the light emission period EP, and the self-scan period SSP will be described below.

For example, a first frame 1Frame may be driven with a first frame frequency FF1, a second frame 2Frame may be driven with a second frame frequency FF2, and the second frame frequency FF2 may be assumed that it is greater than the first frame frequency FF1. Since the first frame frequency FF1 is smaller than the second frame frequency FF2, the number of self-scan periods SSP of the first frame 1Frame may be greater than the number of self-scan periods SSP of the second frame 2Frame. Accordingly, the display apparatus 1000 may drive the first frame 1Frame for a longer time than the second frame 2Frame.

Figure 4:
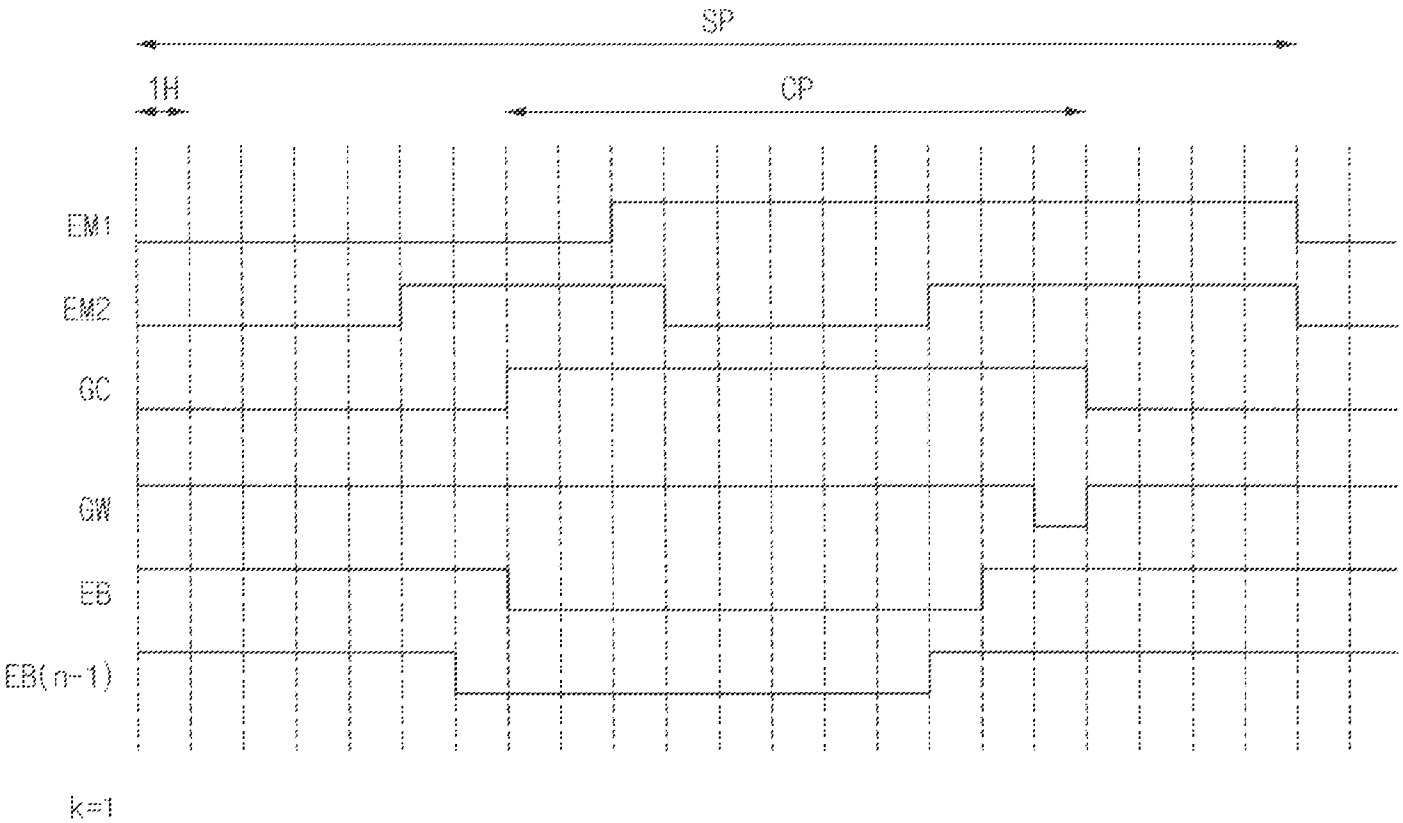
FIG. 4 is a timing diagram illustrating an example of the gate signals and emission signals applied to the pixel circuit of FIG. 1.
Figure 5:
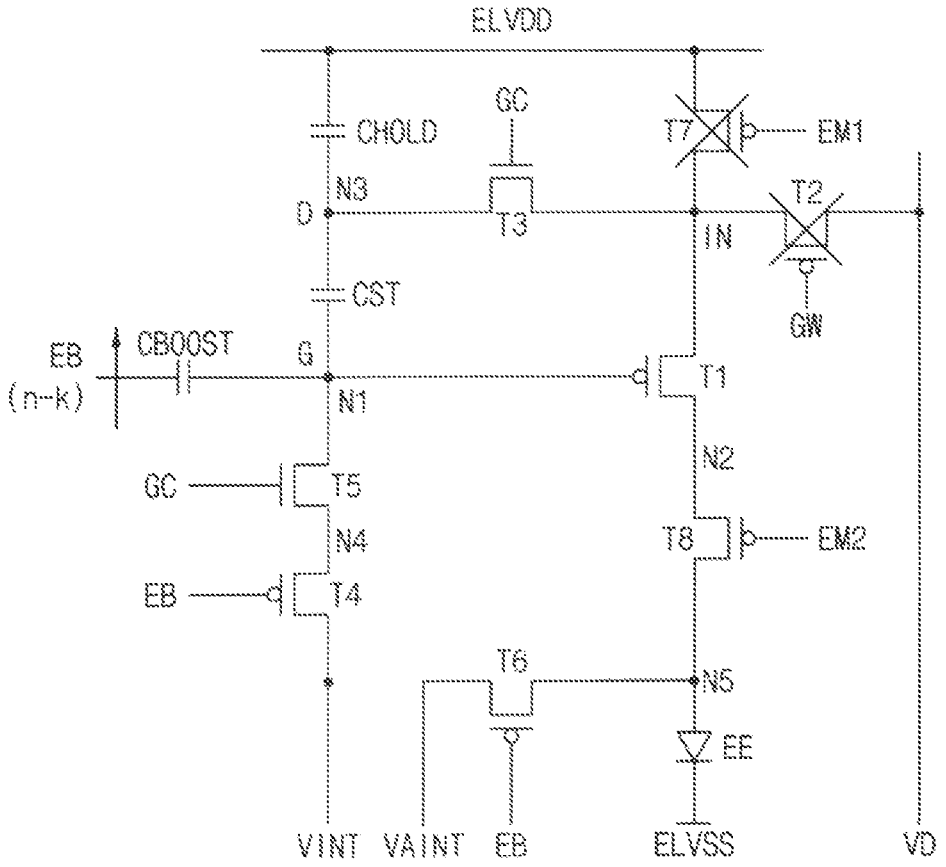
FIG. 5 is a circuit diagram illustrating an example in which the pixel circuit of FIG. 1 is driven in the scan period.

FIG. 4 is a timing diagram illustrating an example of the gate signals GC, GW, and EB and emission signals EM1 and EM2 applied to the pixel circuit 10 of FIG. 1, and FIG. 5 is a circuit diagram illustrating an example in which the pixel circuit 10 of FIG. 1 is driven in the scan period SP. Specifically, FIG. 5 shows an example in which the pixel circuit 10 of FIG. 1 raises the previous initialization gate signal EB(n−1) during a compensation period CP. The gate signals GC, GW, and EB may be applied to the pixel circuit 10 with an interval of one horizontal time 1H for each pixel row. Meanwhile, k is assumed as 1 for convenience of explanation.

Referring to FIGS. 1, 4, and 5, the first initialization transistor T4 may apply the first initialization voltage VINT to the control electrode of the driving transistor T1 in response to the initialization gate signal EB. In some embodiments, the second compensation transistor T5 may apply the first initialization voltage VINT transmitted through the first initialization transistor T4 to the control electrode of the driving transistor T1 in response to the compensation gate signal GC. The second compensation transistor T5 may be an n-type transistor, and the first initialization transistor T4 may be a p-type transistor. In some embodiments, the first compensation transistor T3 and the second compensation transistor T5 may be n-type transistors. The compensation gate signal GC may have a high level in the compensation period CP of the scan period SP. The previous initialization gate signal EB(n−1) may rise to a high level in the compensation period CP.

In an embodiment, the first initialization voltage VINT may be applied to the first node N1 while the first initialization transistor T4 and the second compensation transistor T5 are being turned on in the compensation period CP. Since the previous initialization gate signal EB(n−1) rises while the first initialization voltage VINT is being applied to the first node N1, a difference in luminance between pixels due to distribution of the boost capacitor CBOOST may be reduced.

The write transistor T2 may apply the data voltage VD to the input node IN in response to the write gate signal GW. In some embodiments, the write transistor T2 may apply the data voltage VD to the input node IN in the scan period SP. In some embodiments, the write transistor T2 may be turned on in a state in which the first compensation transistor T3 and the second compensation transistor T5 are turned on in the scan period SP to apply the data voltage VD to the input node IN. The first compensation transistor T3 may compensate for the threshold voltage of the driving transistor T1 in response to the compensation gate signal GC. The storage capacitor CST may store the data voltage where the threshold voltage of the driving transistor T1 is compensated.

In an embodiment, after the first emission transistor T7 is turned off in the compensation period CP, the input node IN may be discharged from the driving voltage ELVDD to the level of voltage where the threshold voltage of the driving transistor T1 is added to the voltage of the first node N1. The first compensation transistor T3 may apply the voltage, in which the threshold voltage of the driving transistor T1 is added to the voltage of the first node N1, to the third node N3. After the voltage, in which the threshold voltage of the driving transistor T1 is added to the voltage of the first node N1, is applied to the third node N3, the write transistor T2 may apply the data voltage VD to the input node IN in the compensation period CP. As a result, a voltage, in which the threshold voltage is subtracted from the data voltage VD, may be applied to the first node N1. In this way, the threshold voltage may be compensated through the driving voltage ELVDD, so that a time for compensating for the threshold voltage may be sufficiently secured compared to the case in which the threshold voltage is compensated through the data voltage VD.

The second initialization transistor T6 may apply the second initialization voltage VAINT to an anode electrode of the light emitting element EE in response to the initialization gate signal EB. The first emission transistor T7 may transmit the driving voltage ELVDD to the input node IN in response to the first emission signal EM1. In some embodiments, the second initialization voltage VAINT may be lower than the first initialization voltage VINT. When the second initialization voltage VAINT is applied to the anode electrode of the light emitting element EE, any parasitic capacitor of the light emitting element EE may be discharged, preventing unintentional micro light emission and improving the ability to express black greyscale of the pixel circuit 10. However, when the second initialization voltage VAINT becomes higher than a predetermined reference, the parasitic capacitor of the light emitting element EE may be charged rather than discharged. Accordingly, the second initialization voltage VAINT may be set to a voltage lower than the common voltage ELVSS. Accordingly, the second initialization voltage VAINT may be set to a voltage lower than the first initialization voltage VINT.

Figure 6:
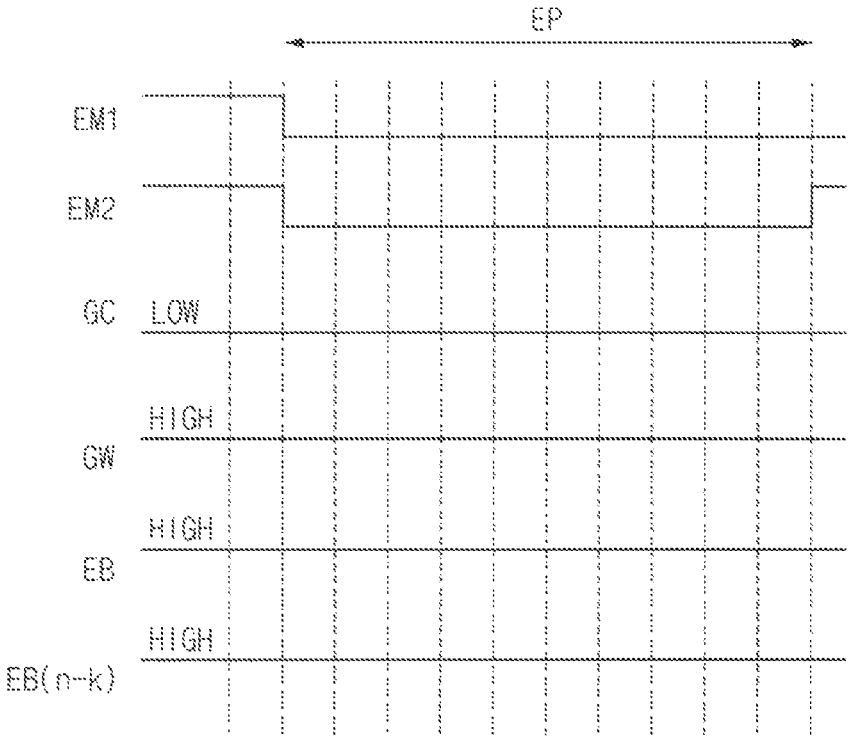
FIG. 6 is a timing diagram illustrating an example of the gate signals and emission signals applied to the pixel circuit of FIG. 1.
Figure 7:
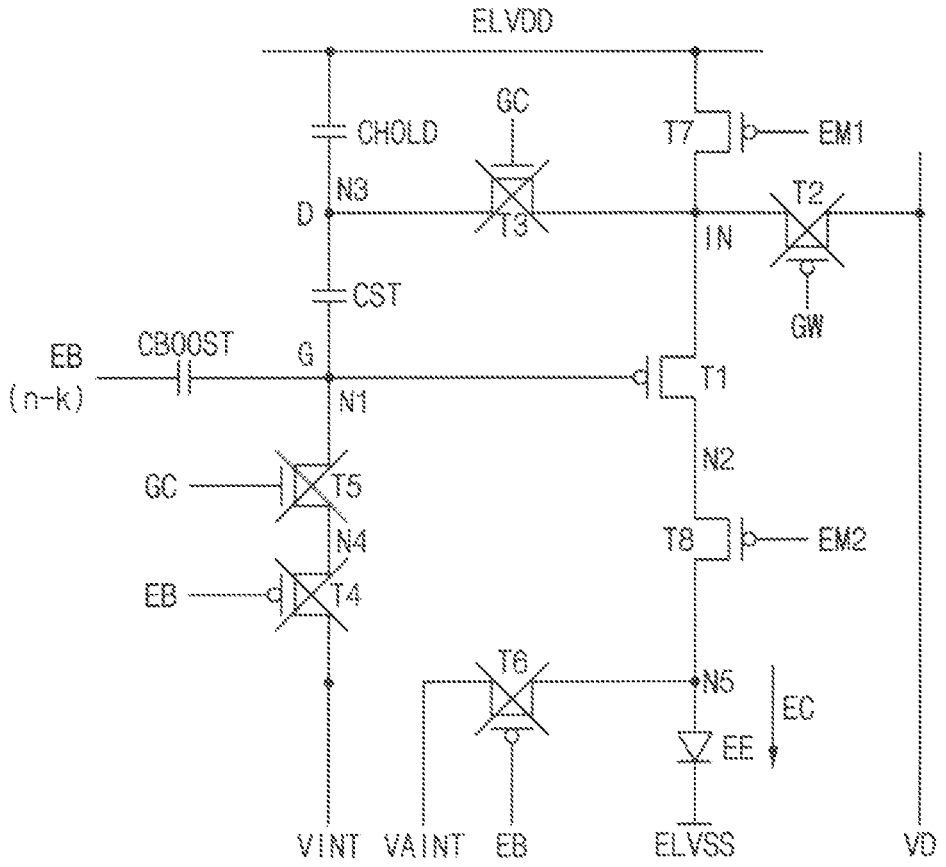
FIG. 7 is a circuit diagram illustrating an example in which the pixel circuit of FIG. 1 is driven in the emission period.

FIG. 6 is a timing diagram illustrating an example of the gate signals GC, GW, and EB and emission signals EM1 and EM2 applied to the pixel circuit 10 of FIG. 1, and FIG. 7 is a circuit diagram illustrating an example in which the pixel circuit 10 of FIG. 1 is driven in the emission period EP. The gate signals GC, GW, and EB may be applied to the pixel circuit 10 with an interval of one horizontal time 1H for each pixel row. Meanwhile, k is assumed as 1 for the purpose of convenience of explanation.

Referring to FIGS. 1, 6, and 7, the driving transistor T1 may apply a driving current EC to the light emitting element EE based on the data voltage where the threshold voltage is compensated. The second emission transistor T8 may transmit the driving current EC to the light emitting element EE in response to the second emission signal EM2.

In an embodiment, a voltage, in which the threshold voltage of the driving transistor T1 is subtracted from the data voltage VD, may be applied to the control electrode of the driving transistor T1 in the emission period EP. The first emission transistor T7 may be turned on to apply the driving voltage ELVDD to the input node IN. The driving transistor T1 may generate the driving current EC based on the driving voltage ELVDD and the voltage, in which the threshold voltage of the driving transistor T1 is subtracted from the data voltage VD. The second emission transistor T8 may be turned on to transmit the driving current EC to the light emitting element EE.

Figure 8:
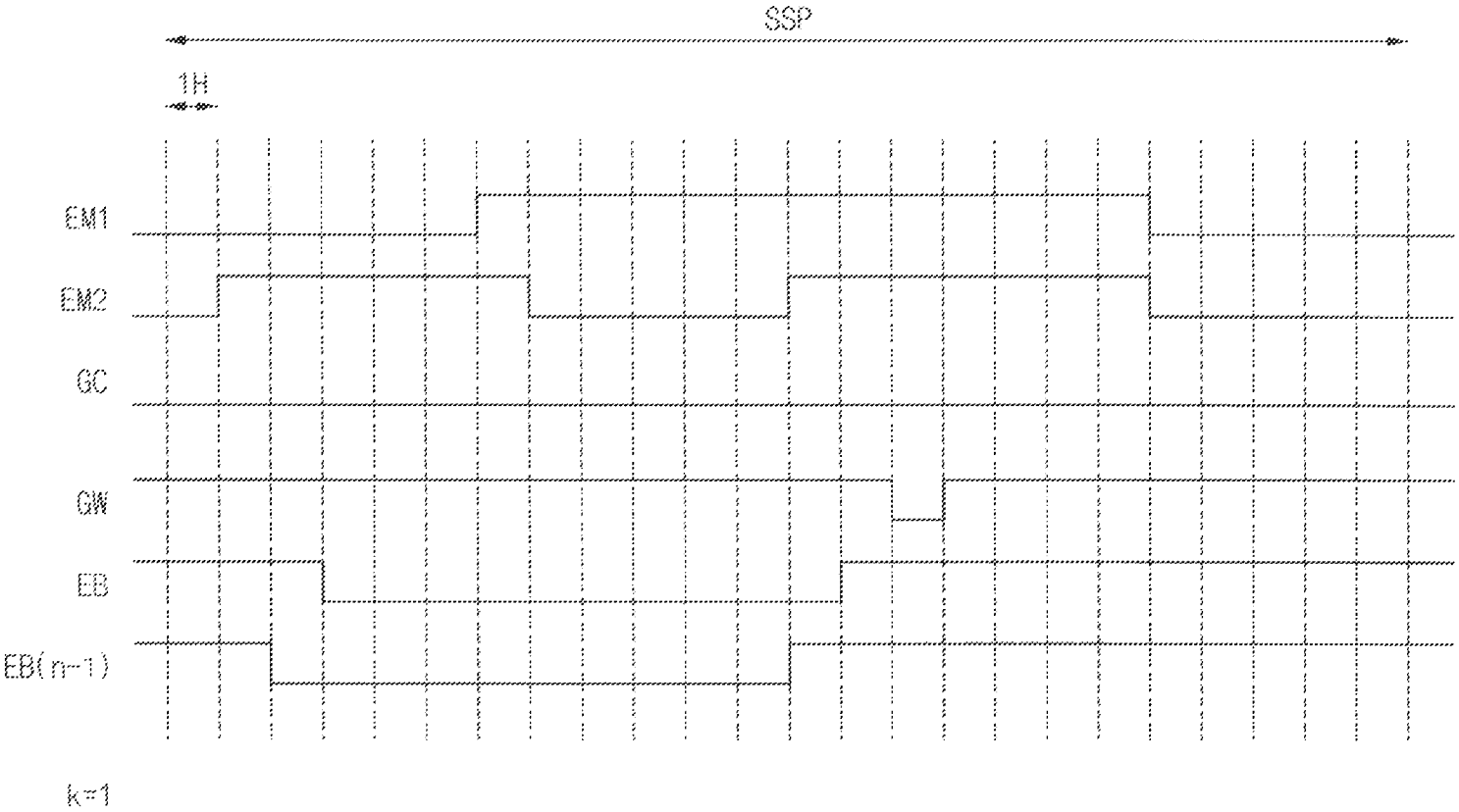
FIG. 8 is a timing diagram illustrating an example of the gate signals and emission signals applied to the pixel circuit of FIG. 1.
Figure 9:
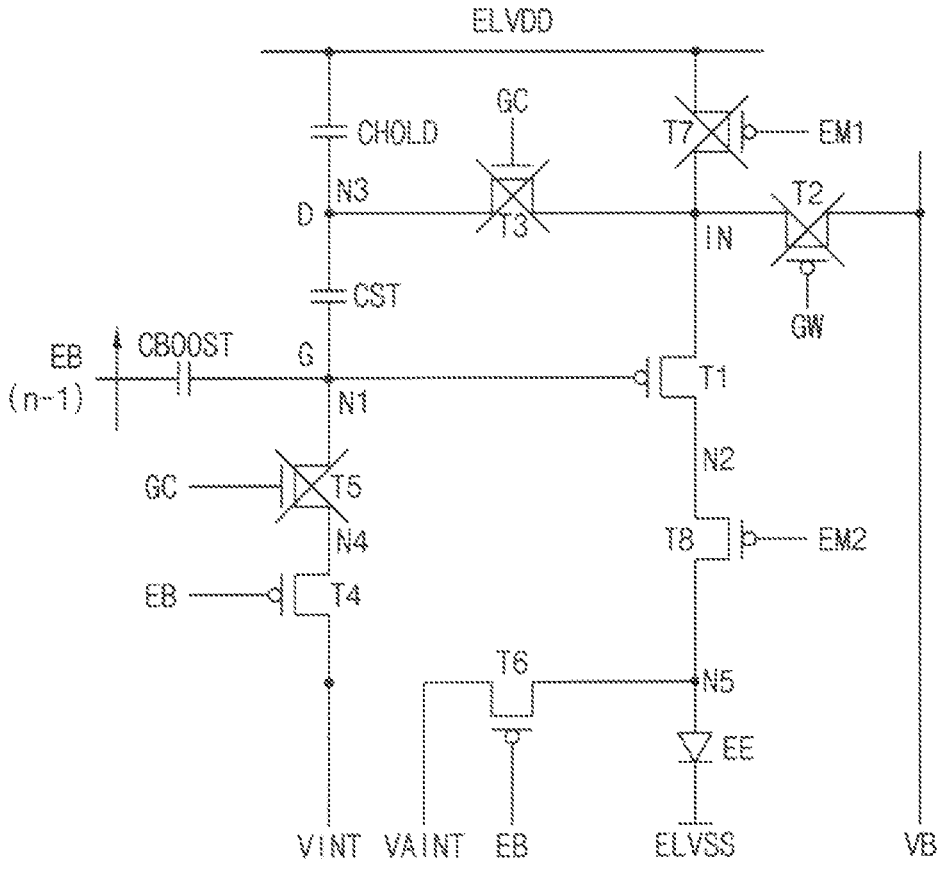
FIG. 9 is a circuit diagram illustrating an example in which the pixel circuit of FIG. 1 is driven in the self-scan period.

FIG. 8 is a timing diagram illustrating an example of the gate signals GC, GW, and EB and emission signals EM1 and EM2 applied to the pixel circuit 10 of FIG. 1, and FIG. 9 is a circuit diagram illustrating an example in which the pixel circuit 10 of FIG. 1 is driven in the self-scan period SSP. Specifically, FIG. 9 shows an example in which the pixel circuit 10 of FIG. 1 raises the previous initialization gate signal EB(n−1) in the self-scan period SSP. The gate signals GC, GW, and EB may be applied to the pixel circuit 10 with an interval of one horizontal time 1H for each pixel row. Meanwhile, k is assumed as 1 for convenience of explanation.

Referring to FIGS. 1, 4, 5, 8, and 9, the compensation gate signal GC may have a low level in the self-scan period SSP. The previous initialization gate signal EB(n−1) may rise to a high level in the self-scan period SSP.

In an embodiment, since the second compensation transistor T5 is turned off in the self-scan period SSP, the second electrode of the boost capacitor CBOOST may be in a floating state. Accordingly, the second electrode of the boost capacitor CBOOST connected to the gate electrode of the driving transistor T1 may be boosted as the previous initialization gate signal EB(n−1) rises to a high level in the self-scan period SSP. As the compensation gate signal GC falls to a low level in the scan period SP, the voltage value of the first node N1 connected to the gate electrode of the driving transistor T1 may decrease. However, the first node N1 may be boosted through the boost capacitor CBOOST, so that a decrease in the voltage of the first node N1 due to the falling of the compensation gate signal GC may be compensated. In addition, since the first node N1 is boosted through the boost capacitor CBOOST, a black voltage VB having a lower voltage value than a case where the boost capacitor CBOOST is absent may be applied. In addition, the boosting voltage value of the first node N1 through the boosting may vary depending on the difference between the high level and the low level of the previous initialization gate signal EB(n−1). Therefore, the voltage of the first node N1 may be adjusted by varying the high level and the low level of the previous initialization gate signal EB(n−1). As a result, the pixel circuit 10 may bias the driving transistor T1 through the boost capacitor CBOOST without a separate bias line, and may enhance the hysteresis characteristic of the driving transistor T1.

In an embodiment, the write transistor T2 may apply the black voltage VB to the input node IN during the self-scan period SSP. In some embodiments, the black voltage VB may have the same value as the value of the data voltage VD that displays the black grayscale image. In some embodiments, the black voltage VB may have the same value as the value of the data voltage VD that displays the lowest grayscale image.

Figure 10:
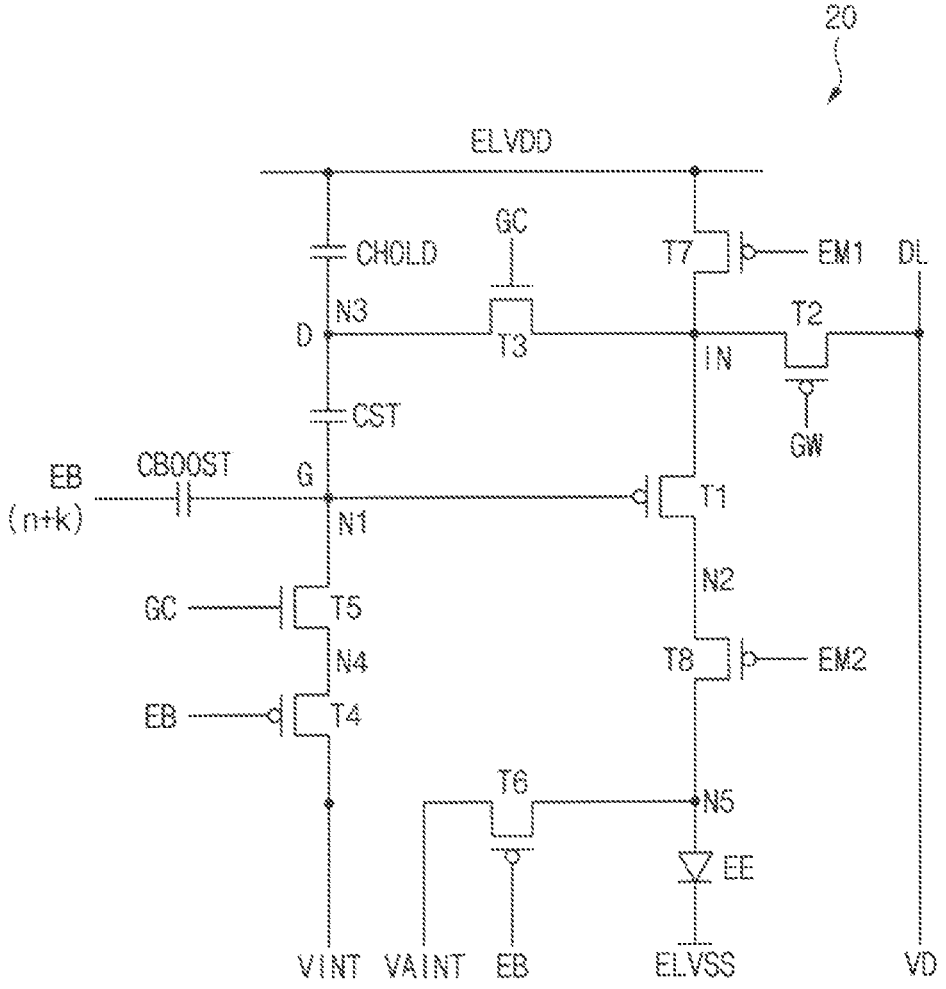
FIG. 10 is a circuit diagram illustrating a pixel circuit according to embodiments of the present inventive concept.

FIG. 10 is a circuit diagram illustrating a pixel circuit 20 according to embodiments of the present inventive concept. The pixel circuit 20 is similar to the pixel circuit 10, with a primary difference being a next initialization gate signal EB(n+k) connected to the boost capacitor CBOOST instead of the previous initialization gate signal EB(n−k).

Referring to FIG. 10, the pixel circuit 20 may include a driving transistor T1 including a control electrode connected to a first node N1, an input electrode connected to an input node IN, and an output electrode connected to a second node N2; a write transistor T2 including a control electrode to which a write gate signal GW is applied, an input electrode to which a data voltage VD (or a black voltage VB) is applied, and an output electrode connected to the input node IN; a first compensation transistor T3 including a control electrode to which a compensation gate signal GC is applied, an input electrode to which the input node IN is connected, and an output electrode to which a third node N3 is connected; a first initialization transistor T4 including a control electrode to which an initialization gate signal EB is applied, an input electrode to which a first initialization voltage VINT is applied, and an output electrode to which a fourth node N4 is connected; a second compensation transistor T5 including a control electrode to which the compensation gate signal GC is applied, an input electrode to which the fourth node N4 is connected, and an output electrode to which the first node N1 is connected; a second initialization transistor T6 including a control electrode to which the initialization gate signal EB is applied, an input electrode to which a second initialization voltage VAINT is applied, and an output electrode to which a fifth node N5 is connected; a first emission transistor T7 including a control electrode to which a first emission signal EM1 is applied, an input electrode to which a driving voltage ELVDD is applied, and an output electrode to which the input node IN is connected; a second emission transistor T8 including a control electrode to which a second emission signal EM2 is applied, an input electrode to which the second node N2 is connected, and an output electrode to which the fifth node N5 is connected; a storage capacitor CST including a first electrode connected to the third node and a second electrode connected to the first node N1; a hold capacitor CHOLD including a first electrode connected to the third node N3 and a second electrode to which the driving voltage ELVDD is applied; a boost capacitor CBOOST including a first electrode to which the next initialization gate signal EB(n+k) (where k is a positive integer) applied to a next pixel row is applied and a second electrode connected to the control electrode of the driving transistor T1; and a light emitting element EE including an anode electrode to which the fifth node N5 is connected and a cathode electrode to which a common voltage ELVSS is connected. In this case, k indicates the position number of the next pixel row. The pixel row may represent a set of pixels connected to one gate line GWL/GCL/EBL.

Figure 11:
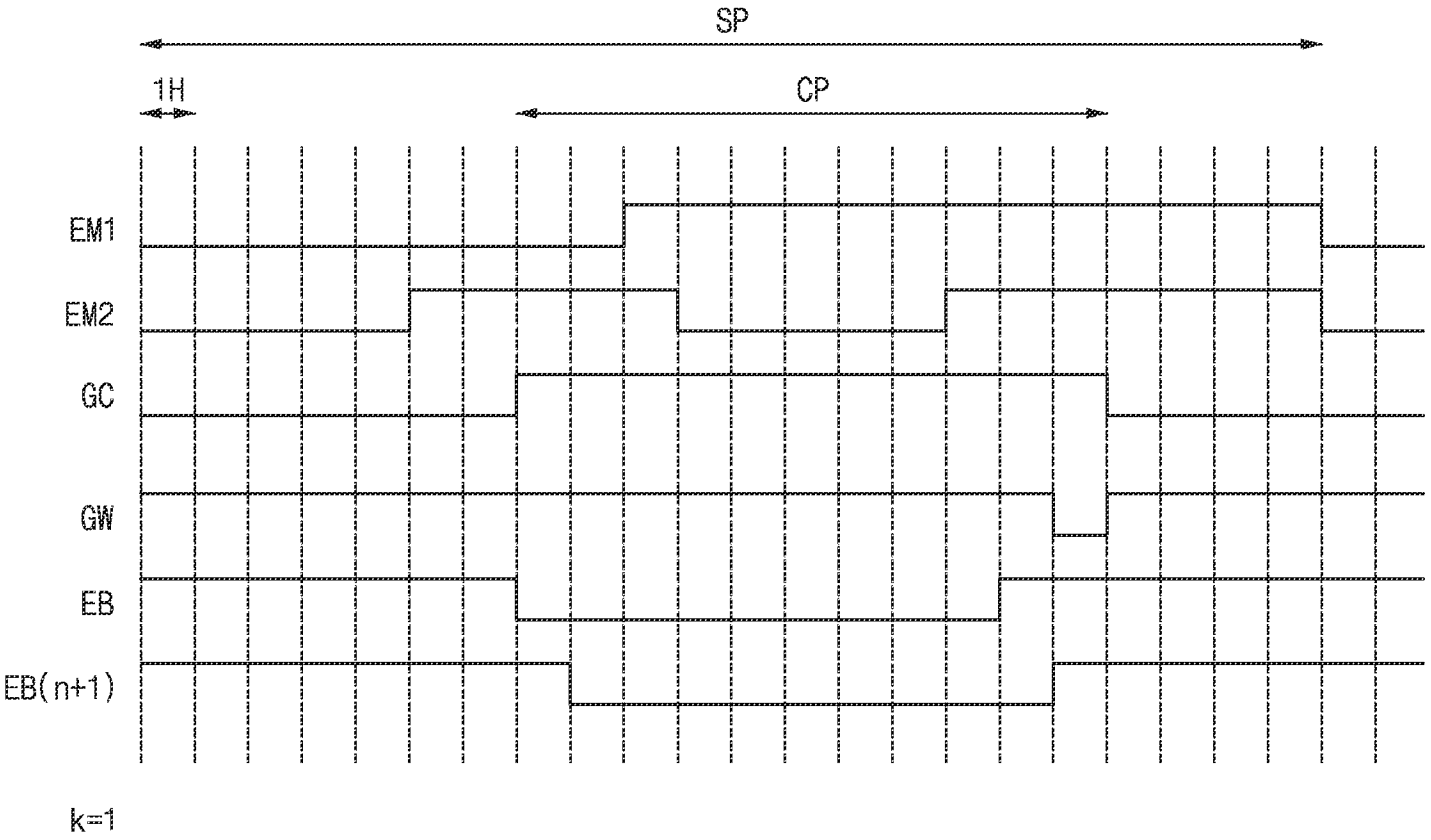
FIG. 11 is a timing diagram illustrating an example of the gate signals and emission signals applied to the pixel circuit of FIG. 10.
Figure 12:
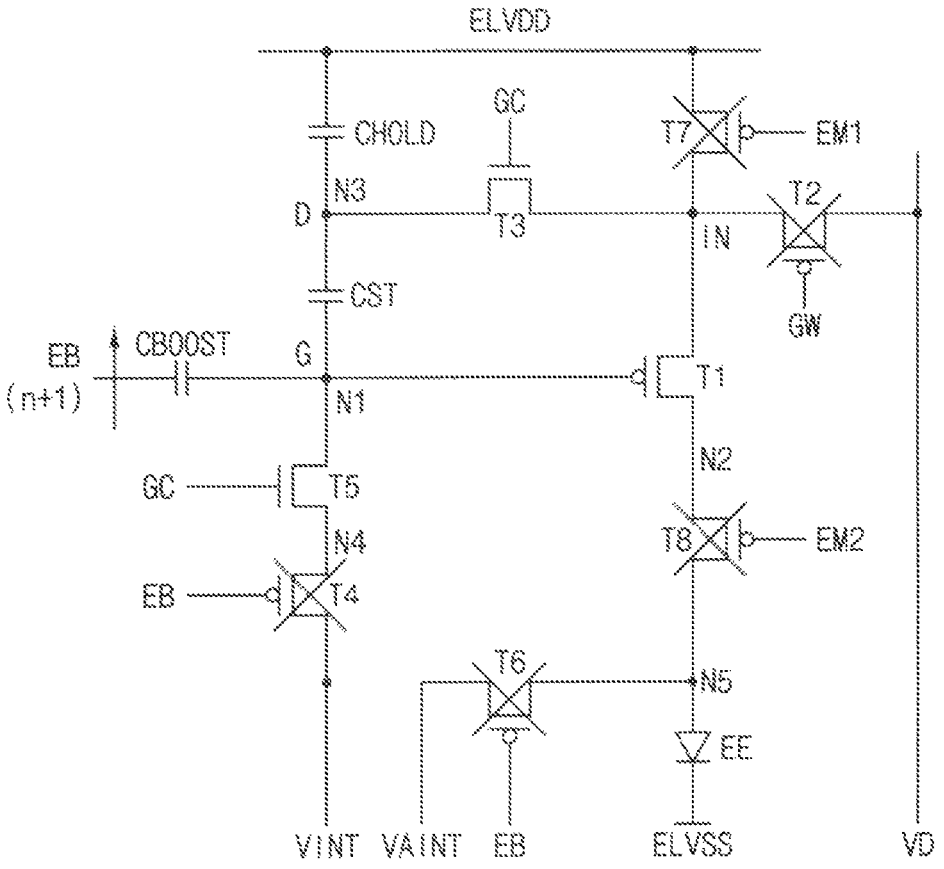
FIG. 12 is a circuit diagram illustrating an example in which the pixel circuit is driven in the scan period.

FIG. 11 is a timing diagram illustrating an example of the gate signals GC, GW, and EB and emission signals EM1 and EM2 applied to the pixel circuit 20 of FIG. 10, and FIG. 12 is a circuit diagram illustrating an example in which the pixel circuit 20 is driven in the scan period SP. Specifically, FIG. 12 shows an example in which the pixel circuit 20 of FIG. 10 rises the next initialization gate signal EB(n+1) in the compensation period CP. The gate signals GC, GW, and EB may be applied to the pixel circuit 20 at an interval of one horizontal time 1H for each pixel row. Meanwhile, k is assumed as 1 for convenience of explanation.

Referring to FIGS. 10, 11, and 12, the first initialization transistor T4 may apply the first initialization voltage VINT to the control electrode of the driving transistor T1 in response to the initialization gate signal EB. In some embodiments, the second compensation transistor T5 may apply the first initialization voltage VINT transmitted through the first initialization transistor T4 to the control electrode of the driving transistor T1 in response to the compensation gate signal GC. The second compensation transistor T5 may be an n-type transistor, and the first initialization transistor T4 may be a p-type transistor. In some embodiments, the first compensation transistor T3 and the second compensation transistor T5 may be n-type transistors. The compensation gate signal GC may have a high level in the compensation period CP of the scan period SP. The next initialization gate signal EB(n+1) may rise to a high level in the compensation period CP.

In an embodiment, since the first compensation transistor T5 is turned off when the next initialization gate signal EB(n+1) rises to the high level, the second electrode of the boost capacitor CBOOST may be in a floating state. Accordingly, the second electrode of the boost capacitor CBOOST connected to the gate electrode of the driving transistor T1 may be boosted as the next initialization gate signal EB(n+1) rises to a high level in the self-scan period SSP. As the compensation gate signal GC falls to a low level in the scan period SP, the voltage value of the first node N1 connected to the gate electrode of the driving transistor T1 may decrease. However, the first node N1 may be boosted through the boost capacitor CBOOST, so that a decrease in the voltage of the first node N1 due to the falling of the compensation gate signal GC may be compensated in advance. In addition, since the first node N1 is boosted through the boost capacitor CBOOST, a black voltage VB having a lower voltage value than a case where the boost capacitor CBOOST is absent may be applied. In addition, the boosting voltage value of the first node N1 through the boosting may vary depending on the difference between the high level and the low level of the next initialization gate signal EB(n+1). Therefore, the voltage of the first node N1 may be adjusted by varying the high level and the low level of the next initialization gate signal EB(n+1). As a result, the pixel circuit 20 may bias the driving transistor T1 through the boost capacitor CBOOST without a separate bias line, and may enhance the hysteresis characteristic of the driving transistor T1.

The write transistor T2 may apply the data voltage VD to the input node IN in response to the write gate signal GW. In some embodiments, the write transistor T2 may apply the data voltage VD to the input node IN during the scan period SP. In some embodiments, the write transistor T2 may be turned on in a state in which the first compensation transistor T3 and the second compensation transistor T5 are turned on in the scan period SP to apply the data voltage VD to the input node IN. The first compensation transistor T3 may compensate for the threshold voltage of the driving transistor T1 in response to the compensation gate signal GC. The storage capacitor CST may store the data voltage where the threshold voltage of the driving transistor T1 is compensated.

In an embodiment, after the first emission transistor T7 is turned off in the compensation period CP, the input node IN may be discharged from the driving voltage ELVDD to the level of voltage where the threshold voltage of the driving transistor T1 is added to the voltage of the first node N1. The first compensation transistor T3 may apply the voltage, in which the threshold voltage of the driving transistor T1 is added to the voltage of the first node N1, to the third node N3. After the voltage, in which the threshold voltage of the driving transistor T1 is added to the voltage of the first node N1, is applied to the third node N3, the write transistor T2 may apply the data voltage VD to the input node IN in the compensation period CP. As a result, a voltage, in which the threshold voltage is subtracted from the data voltage VD, may be applied to the first node N1. In this way, the threshold voltage may be compensated through the driving voltage ELVDD, so that a time for compensating for the threshold voltage may be sufficiently secured compared to the case in which the threshold voltage is compensated through the data voltage VD.

The second initialization transistor T6 may apply the second initialization voltage VAINT to an anode electrode of the light emitting element EE in response to the initialization gate signal EB. The first emission transistor T7 may transmit the driving voltage ELVDD to the input node IN in response to the first emission signal EM1. In some embodiments, the second initialization voltage VAINT may be lower than the first initialization voltage VINT. When the second initialization voltage VAINT is applied to the anode electrode of the light emitting element EE, a parasitic capacitance of the light emitting element EE may be discharged, so that unintentional micro light emission may be prevented and the ability to express black greyscale of the pixel circuit 20 may be improved. However, when the second initialization voltage VAINT becomes higher than a predetermined reference, the parasitic capacitor of the light emitting element EE may be charged rather than discharged. Accordingly, the second initialization voltage VAINT may be set to a voltage lower than a common voltage ELVSS. Accordingly, the second initialization voltage VAINT may be set to a voltage lower than the first initialization voltage VINT.

Figure 13:
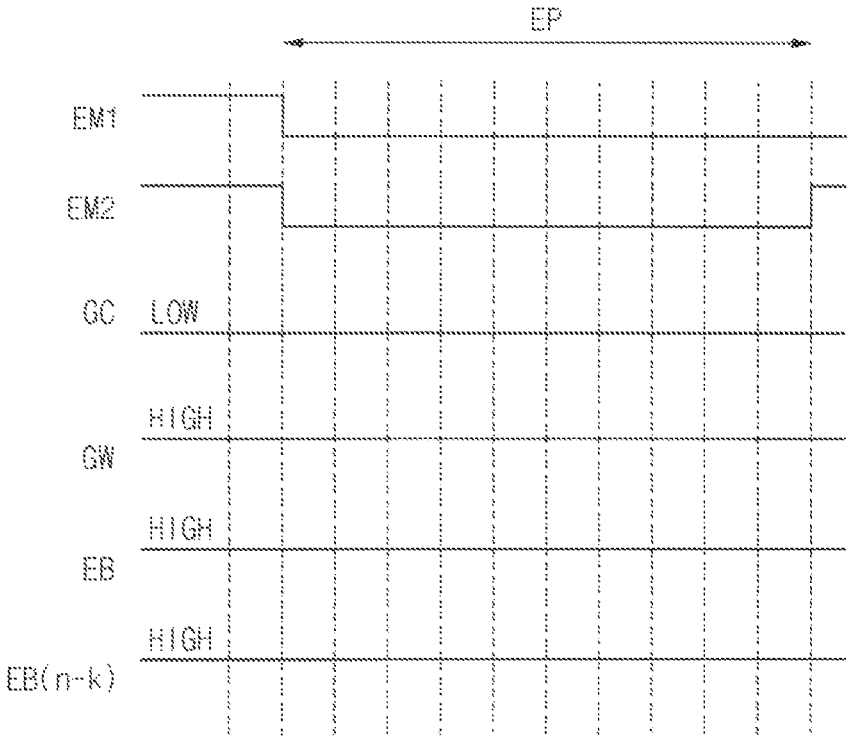
FIG. 13 is a timing diagram illustrating an example of the gate signals and emission signals applied to the pixel circuit of FIG. 10.
Figure 14:
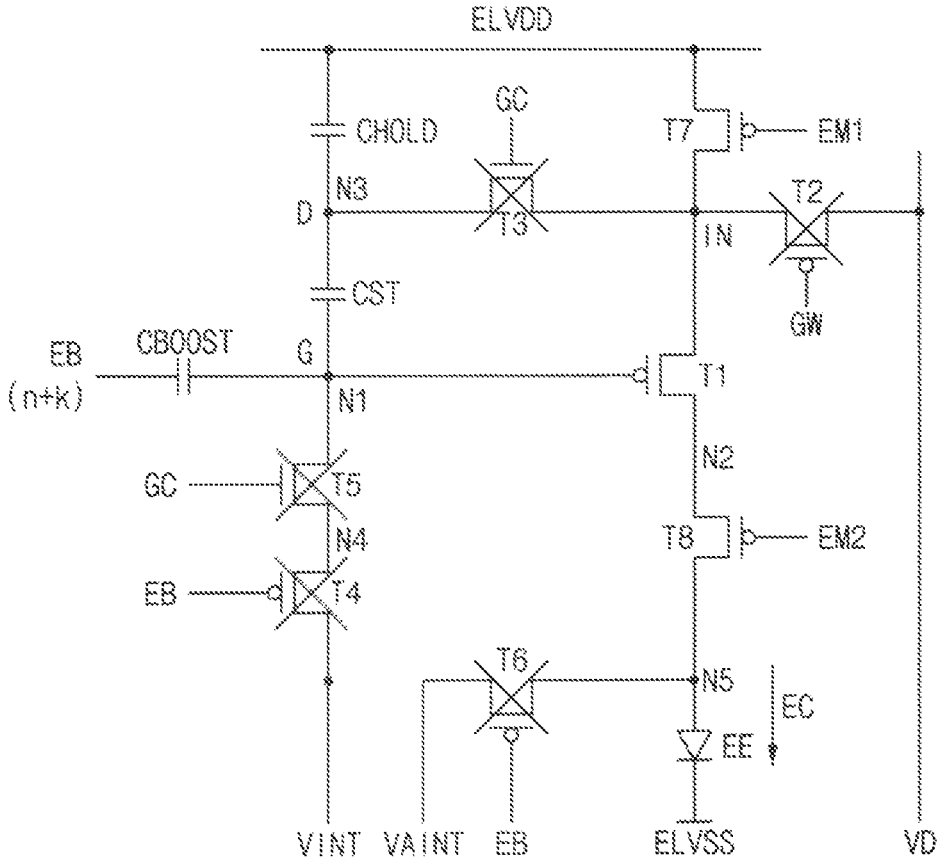
FIG. 14 is a circuit diagram illustrating an example in which the pixel circuit of FIG. 10 is driven in the emission period.

FIG. 13 is a timing diagram illustrating an example of the gate signals GC, GW, and EB and emission signals EM1 and EM2 applied to the pixel circuit 20 of FIG. 10, and FIG. 14 is a circuit diagram illustrating an example in which the pixel circuit 20 of FIG. 10 is driven in the emission period EP. The gate signals GC, GW, and EB may be applied to the pixel circuit 20 at an interval of one horizontal time 1H for each pixel row. Meanwhile, k is assumed as 1 for convenience of explanation.

Referring to FIGS. 10, 13, and 14, the driving transistor T1 may apply a driving current to the light emitting element EE based on the data voltage where the threshold voltage is compensated. The second emission transistor T8 may transmit the driving current EC to the light emitting element EE in response to the second emission signal EM2.

In an embodiment, a voltage, in which the threshold voltage of the driving transistor T1 is subtracted from the data voltage VD, may be applied to the control electrode of the driving transistor T1 in the emission period EP. The first emission transistor T7 may be turned on to apply the driving voltage ELVDD to the input node IN. The driving transistor T1 may generate the driving current EC based on the driving voltage ELVDD and the voltage, in which the threshold voltage of the driving transistor T1 is subtracted from the data voltage VD. The second emission transistor T8 may be turned on to transmit the driving current EC to the light emitting element EE.

Figure 15:
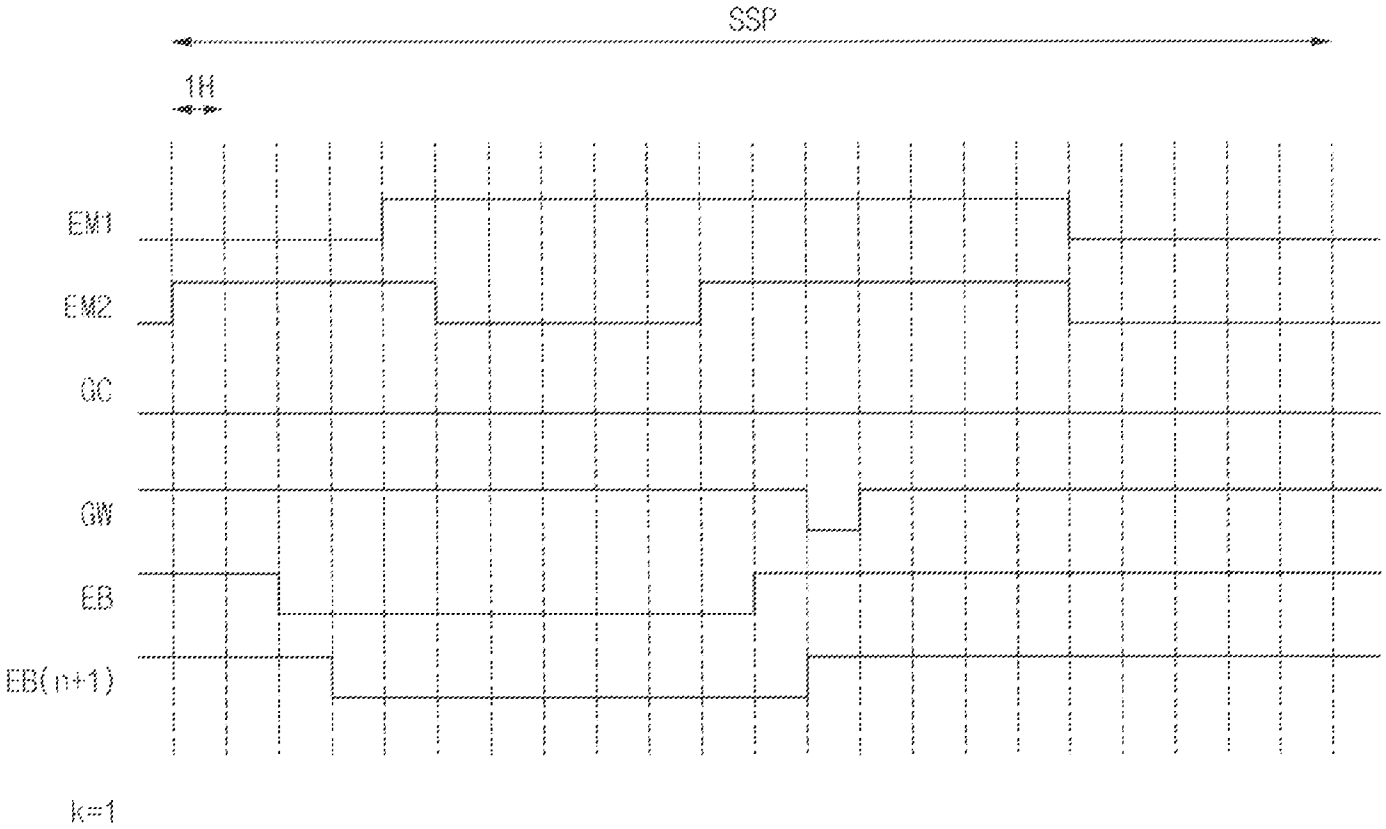
FIG. 15 is a timing diagram illustrating an example of the gate signals and emission signals applied to the pixel circuit 20 of FIG. 10.
Figure 16:
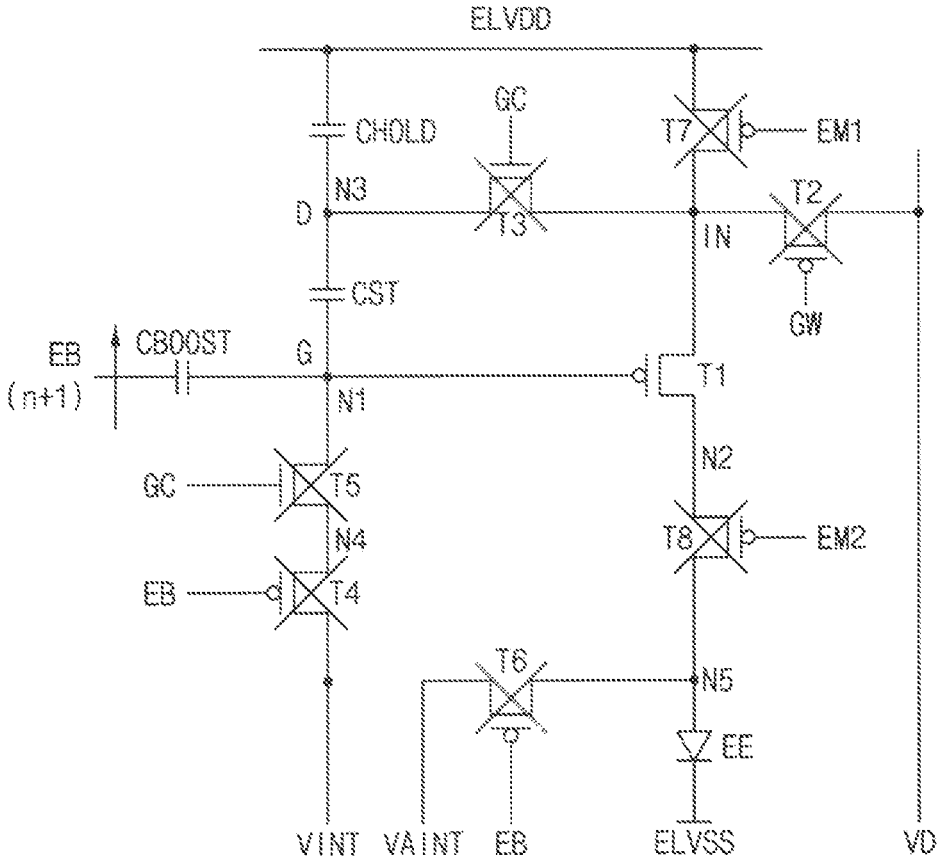
FIG. 16 is a circuit diagram illustrating an example in which the pixel circuit of FIG. 10 is driven in the self-scan period.

FIG. 15 is a timing diagram illustrating an example of the gate signals GC, GW, and EB and emission signals EM1 and EM2 applied to the pixel circuit 20 of FIG. 10, and FIG. 16 is a circuit diagram illustrating an example in which the pixel circuit 20 of FIG. 10 is driven in the self-scan period SSP. Specifically, FIG. 16 shows an example in which the pixel circuit 20 of FIG. 1 raises the next initialization gate signal EB(n+1) in the self-scan period SSP. The gate signals GC, GW, and EB may be applied to the pixel circuit 20 with an interval of one horizontal time 1H for each pixel row. Meanwhile, k is assumed as 1 for convenience of explanation.

Referring to FIGS. 10, 11, 12, 15, and 16, the compensation gate signal GC may have a low level in the self-scan period SSP. The next initialization gate signal EB(n+1) may rise to a high level in the self-scan period SSP.

In an embodiment, since the second compensation transistor T5 is turned off in the self-scan period SSP, the second electrode of the boost capacitor CBOOST may be in a floating state. Accordingly, the second electrode of the boost capacitor CBOOST connected to the gate electrode of the driving transistor T1 may be boosted as the next initialization gate signal EB(n+1) rises to a high level in the self-scan period SSP. As the compensation gate signal GC falls to a low level in the scan period SP, the voltage value of the first node N1 connected to the gate electrode of the driving transistor T1 may decrease. However, the first node N1 may be boosted through the boost capacitor CBOOST, so that a decrease in the voltage of the first node N1 due to the falling of the compensation gate signal GC may be compensated. In addition, since the first node N1 is boosted through the boost capacitor CBOOST, a black voltage VB having a lower voltage value than in a case where the boost capacitor CBOOST is absent may be applied. In addition, the boosting voltage value of the first node N1 through the boosting may vary depending on the difference between the high level and the low level of the next initialization gate signal EB(n+1). Therefore, the voltage of the first node N1 may be adjusted by varying the high level and the low level of the next initialization gate signal EB(n+1). As a result, the pixel circuit 20 may bias the driving transistor T1 through the boost capacitor CBOOST without a separate bias line, and may enhance the hysteresis characteristic of the driving transistor T1.

In an embodiment, the write transistor T2 may apply the black voltage VB to the input node IN during the self-scan period SSP. In some embodiments, the black voltage VB may have the value the same as the value of the data voltage VD that displays the black grayscale image. In some embodiments, the black voltage VB may have the value the same as the value of the data voltage VD that displays the lowest grayscale image.

The inventive concepts may be applied to any electronic apparatus including the display apparatus. For example, the inventive concepts may be applied to a television (TV), a digital TV, a 3D TV, a mobile phone, a smart phone, a tablet computer, a virtual reality (VR) apparatus, a wearable electronic apparatus, a personal computer (PC), a home appliance, a laptop computer, a personal digital assistant (PDA), a portable multimedia player (PMP), a digital camera, a music player, a portable game console, a navigation apparatus, etc.

The foregoing is illustrative of the present inventive concept and is not to be construed as limiting thereof. Although a few exemplary embodiments of the present inventive concept have been described, those skilled in the art will readily appreciate that many modifications are possible in the exemplary embodiments without materially departing from the novel teachings and advantages of the present inventive concept. Accordingly, all such modifications are intended to be included within the scope of the present inventive concept as defined in the claims. In the claims, any means-plus-function clauses are intended to cover the structures described herein as performing the recited function and not only structural equivalents but also equivalent structures. Therefore, it is to be understood that the foregoing is illustrative of the present inventive concept and is not to be construed as limited to the specific exemplary embodiments disclosed, and that modifications to the disclosed exemplary embodiments, as well as other exemplary embodiments, are intended to be included within the scope of the appended claims. The present inventive concept is defined by the following claims, with equivalents of the claims to be included therein.

What is claimed is:

1. A pixel circuit comprising:

a light emitting element;

a write transistor configured to apply a data voltage to an input node in response to a write gate signal;

a storage capacitor configured to store the data voltage;

a driving transistor configured to apply a driving current to the light emitting element based on the data voltage;

a first compensation transistor configured to compensate for a threshold voltage of the driving transistor in response to a compensation gate signal;

a first initialization transistor configured to apply a first initialization voltage to a control electrode of the driving transistor in response to an initialization gate signal; and a boost capacitor including a first electrode to which a previous initialization gate signal applied to a previous pixel row is applied and a second electrode connected to the control electrode of the driving transistor.

2. The pixel circuit of claim 1, further comprising:

a second compensation transistor configured to apply the first initialization voltage transmitted through the first initialization transistor to the control electrode of the driving transistor in response to the compensation gate signal.

3. The pixel circuit of claim 2, wherein the second compensation transistor is an n-type transistor, and wherein the first initialization transistor is a p-type transistor.

4. The pixel circuit of claim 3, wherein the write transistor is configured to apply the data voltage to the input node in a scan period and apply a black voltage to the input node in a self-scan period, and wherein the compensation gate signal has a high level in a compensation period of the scan period and a low level in the self-scan period.

5. The pixel circuit of claim 4, wherein the black voltage has a value equal to a voltage value of the data voltage displaying an image of a black grayscale.

6. The pixel circuit of claim 4, wherein the previous initialization gate signal rises to a high level in the compensation period.

7. The pixel circuit of claim 4, wherein the write transistor is turned on in a state in which the first compensation transistor and the second compensation transistor are turned on in the scan period to apply the data voltage to the input node.

8. The pixel circuit of claim 4, wherein the previous initialization gate signal rises to a high level in the self-scan period.

9. The pixel circuit of claim 2, further comprising:

a second initialization transistor configured to apply a second initialization voltage to an anode electrode of the light emitting element in response to the initialization gate signal;

a hold capacitor including a first electrode connected to the first electrode of the storage capacitor and a second electrode connected to a driving voltage;

a first emission transistor configured to transmit the driving voltage to the input node in response to a first emission signal; and a second emission transistor configured to transmit the driving current to the light emitting element in response to a second emission signal.

10. The pixel circuit of claim 9, wherein the second initialization voltage is smaller than the first initialization voltage.

11. A pixel circuit comprising:

a light emitting element;

a write transistor configured to apply a data voltage to an input node in response to a write gate signal;

a storage capacitor configured to store the data voltage;

a driving transistor configured to apply a driving current to the light emitting element based on the data voltage;

a first compensation transistor configured to compensate for a threshold voltage of the driving transistor in response to a compensation gate signal;

a first initialization transistor configured to apply a first initialization voltage to a control electrode of the driving transistor in response to an initialization gate signal; and a boost capacitor including a first electrode to which a next initialization gate signal applied to a next pixel row is applied and a second electrode connected to the control electrode of the driving transistor.

12. The pixel circuit of claim 11, further comprising:

a second compensation transistor configured to apply the first initialization voltage transmitted through the first initialization transistor to the control electrode of the driving transistor in response to the compensation gate signal.

13. The pixel circuit of claim 12, wherein the second compensation transistor is an n-type transistor, and wherein the first initialization transistor is a p-type transistor.

14. The pixel circuit of claim 13, wherein the write transistor is configured to apply the data voltage to the input node in a scan period and apply a black voltage to the input node in a self-scan period, and wherein the compensation gate signal has a high level in a compensation period of the scan period and a low level in the self-scan period.

15. The pixel circuit of claim 14, wherein the black voltage has a value equal to a voltage value of the data voltage displaying an image of a black grayscale.

16. The pixel circuit of claim 14, wherein the next initialization gate signal rises to a high level in the compensation period.

17. The pixel circuit of claim 14, wherein the write transistor is turned on in a state in which the first compensation transistor and the second compensation transistor are turned on in the scan period to apply the data voltage to the input node.

18. The pixel circuit of claim 14, wherein the next initialization gate signal rises to a high level in the self-scan period.

19. The pixel circuit of claim 12, further comprising:

a second initialization transistor configured to apply a second initialization voltage to an anode electrode of the light emitting element in response to the initialization gate signal;

a hold capacitor including a first electrode connected to the first electrode of the storage capacitor and a second electrode connected to a driving voltage;

a first emission transistor configured to transmit the driving voltage to the input node in response to a first emission signal; and a second emission transistor configured to transmit the driving current to the light emitting element in response to a second emission signal.

20. The pixel circuit of claim 19, wherein the second initialization voltage is smaller than the first initialization voltage.

* * * * *